United States Patent [19]

Tortorici

[11] Patent Number: 4,699,075

[45] Date of Patent: Oct. 13, 1987

[54] BOAT DAVIT FOR MOUNTING ON BULKHEADS

[76] Inventor: Peter C. Tortorici, 10 Fulton St., East Rockaway, N.Y. 11518

[21] Appl. No.: 896,971

[22] Filed: Aug. 15, 1986

[51] Int. Cl.[4] ..... B63B 21/04

[52] U.S. Cl. ..... 114/230

[58] Field of Search ..... 114/230, 368, 369, 370, 114/250, 364; 254/394

[56] References Cited

U.S. PATENT DOCUMENTS

| | | | |
|---|---|---|---|
| 2,440,972 | 5/1948 | Peltier | 114/230 |
| 3,151,595 | 10/1964 | Stainbrook | 114/230 |
| 3,183,877 | 5/1965 | Benzel | 114/230 |
| 3,464,214 | 9/1969 | King | 114/230 |
| 3,695,209 | 10/1972 | Giese | 114/230 |

*Primary Examiner*—Joseph F. Peters, Jr.

*Assistant Examiner*—Edwin L. Swinehart

*Attorney, Agent, or Firm*—James P. Malone

[57] ABSTRACT

Boat davit for mounting on a bulkhead. A right angle plate has two perpendicular portions, one vertical and one horizontal, the horizontal portion having holes to permit bolting to a bulkhead. A first straight pipe is affixed to the vertical portion of said plate. A second pipe is mounted on the first pipe for vertical movement, the upper portion of the second pipe being bent at an angle of approximately 45°. A first pulley is mounted at the upper end of the second pipe and a second pulley is mounted on the second pipe just above the bend in the pipe. A rope is mounted the pulleys. A weight is connected to one end of the rope, the othe end of the rope being adapted to be connected to a boat, whereby the boat will be held away from the bulkhead and will rise and fall with the tide.

4 Claims, 2 Drawing Figures

BOAT DAVIT FOR MOUNTING ON BULKHEADS

TECHNICAL FIELD

This invention relates to boat davits for mooring boats with tidal adjustment, and more particularly to such means adapted to be mounted on bulkheads or docks.

In tidal waters, a boat cannot be moored directly to the dock since it must rise and fall with the tides, for instance, four to five feet.

PRIOR ART

The prior art includes boat davits for many different purposes, mostly for mounting on ships and for instance, U.S. Pat. Nos. 67,419, 145,873, 1,205,762, 1,369,133, 1,573,196, 2,045,587, 2,888,152.

None of the references show Applicant's specific design for boat davits designed for easy mounting on bulkheads or docks, with tidal adjustment.

THE INVENTION

Boat davit for mounting on a bulkhead. A right angle plate has two perpendicular portions, one vertical and one horizontal, the horizontal portion having holes to permit bolting to a bulkhead. A first straight pipe is affixed to the vertical portion of said plate. A second pipe is mounted on the first pipe for vertical movement, the upper portion of the second pipe being bent at an angle of approximately 45°, for mooring boats with tidal adjustment.

OBJECTS

Accordingly, a principal object of the invention is to provide new and improved boat davit means for mounting on bulkheads or docks, for mooring boats with tidal adjustment.

Another object of the invention is to provide new and improved boat davit means for mounting on bulkheads or docks having means to adjust the vertical height of the davits.

Another object is to provide a new and improved boat davit for mounting on a bulkhead comprising: a right angle plate having two perpendicular portions, one vertical and one horizontal, the horizontal portion having holes to permit bolting to a bulkhead, a first straight pipe affixed to the vertical portion of said plate, a second pipe mounted on the first pipe for vertical movement, the upper portion of the second pipe being bent at an angle of approximately 45°.

These and other objects of the invention will be apparent from the following specification and drawings.

BEST MODE OF THE INVENTION

Figure 1:
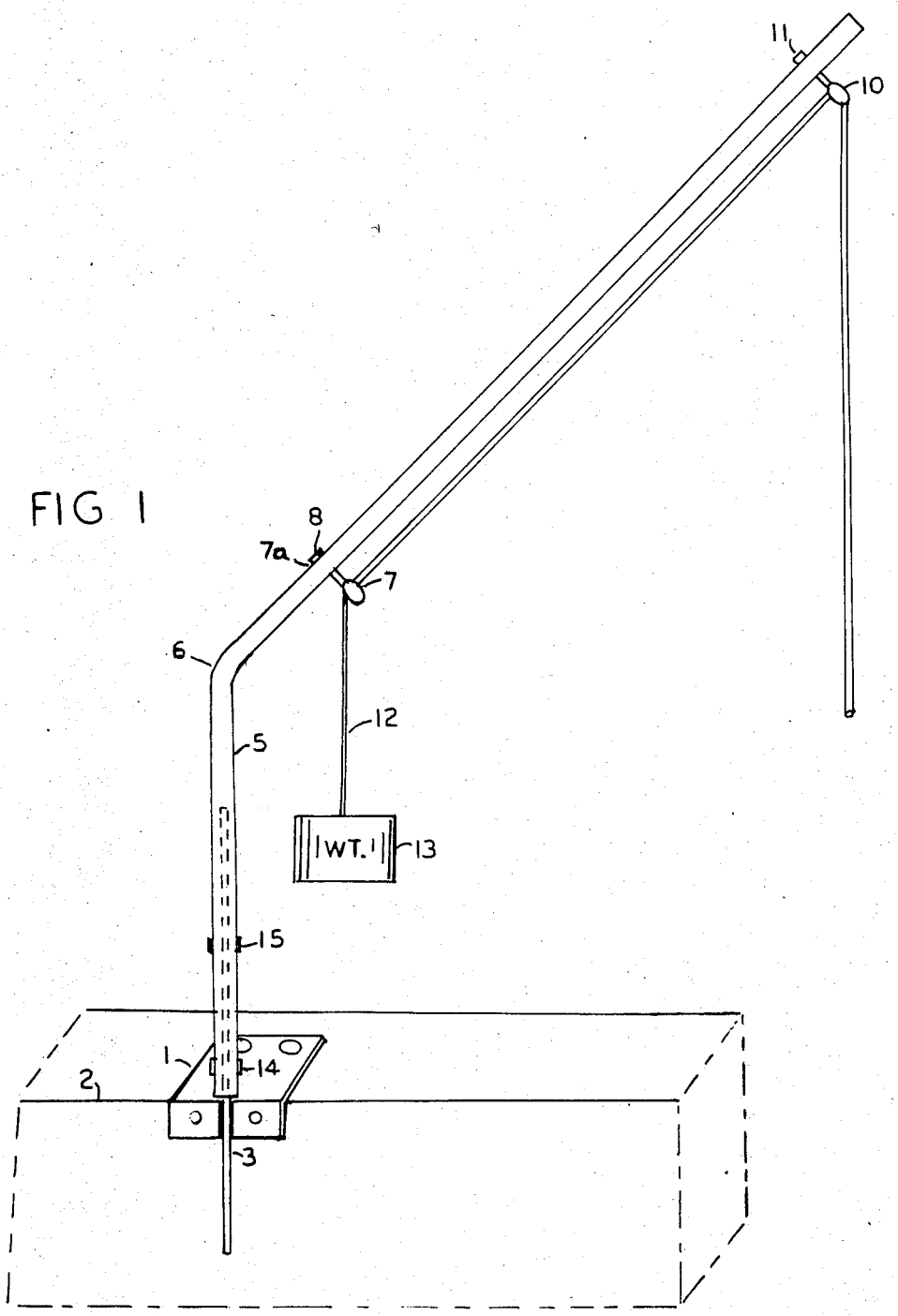
FIG. 1 is a perspective view of an embodiment of the invention.
Figure 2:
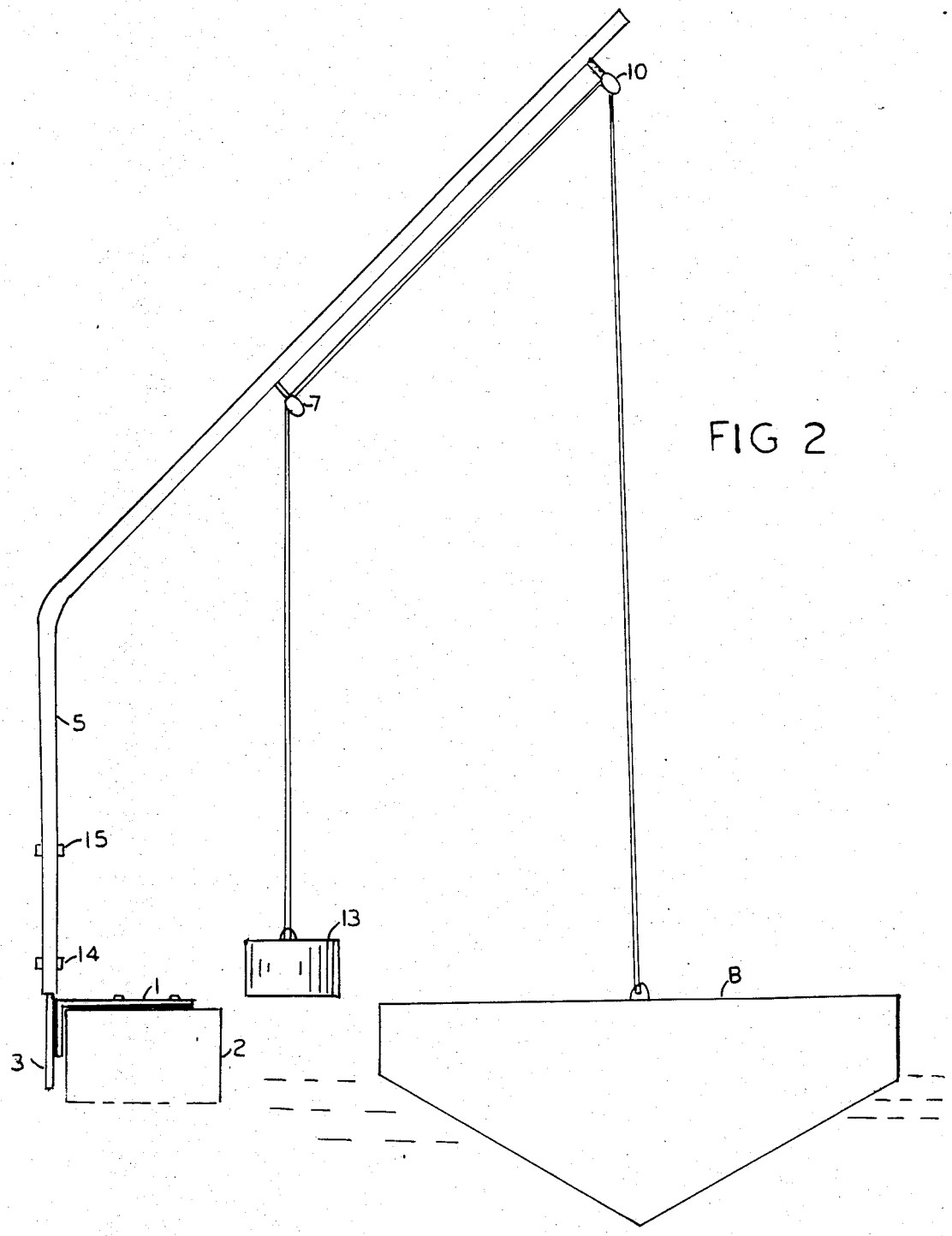
FIG. 2 is a side view of an embodiment of the invention.

Referring to the drawings, a right angled plate 1, is mounted on the bulkhead or dock 2, for instance, by means of large screws or bolts. One portion, 1*a* of the plate is in the vertical plane and the other portion, 1*b* is in the horizontal plane.

A pipe 3 is welded or otherwise affixed along the area 4 of the vertical portion of the plate 1. A second pipe 5 is mounted outside the first pipe 3. The second pipe 5 had a bend 6, so that when mounted it will extend out over the water. The pipes may be galvanized and the bend 6 may be formed with a hydraulic bending apparatus. The size of the pipe 5 is chosen according to the beam or width of the boat so that the boat may be lifted or lowered without interferring with the edge of the bulkhead or the dock.

A first pulley 7, is mounted on the lower end of the upper portion of the pipe 6 at the point 7*a*. The pulley is preferably bolted to the pipe by means of the eye bolt 8, so that the position of the swivel pulley may be adjusted along the upper portion of the pipe 6.

A second swivel pulley 10 is similarly bolted or clamped to the upper portion of the pipe 6 by means of an eye bolt or clamp 11, rope 12 is passed from the boat through the swivel pulleys 7 and 10. The other end of the rope 12 is attached to weight 13, so that the boat B may rise and fall with the tides and will be kept away from the dock.

The davits are preferably spaced along the bulkhead a distance longer that the length of a boat. The pipe assembly in FIG. 1, is shown rotated so its plane is parallel to the bulkhead front edge. The upper pipe 5 is also rotatable with respect to the lower pipe 3.

The pipe 5 is adjustably mounted on the pipe 3 in the vertical direction, for instance, by means of bolts 14, 15, with corresponding holes in the pipes.

The plate is preferably a hot dipped galvanized plate, for instance 5/16" and the pipe 3 is doubly welded to the vertical portion of the plate 1.

Therefore, the present invention provides new and improved boat davits which are adapted to be easily mounted on bulkheads or docks, most of which are constructed of wood.

It is claimed:

1. Boat davit for mounting on a fixed bulkhead comprising:

a right angle plate having two perpendicular portions one vertical and one horizontal, the horizontal portion having holes to permit bolting to a bulkhead, a first straight pipe affixed to the vertical portion of said plate, a second pipe mounted on the first pipe for vertical adjustment movement when not in use to extend vertical operating potential, the upper portion of the second pipe being bent at an angle of approximately 45°, a first pulley mounted at the upperend of the second pipe and a second pulley mounted on the second pipe just above the bend in said pipe, a rope mounted in said pulleys, a weight connected to one end of the rope, the other end of the rope being adapted to be connected to a boat, whereby the boat will be held away from the bulkhead and will rise and fall with the tide.

2. Apparatus as in claim 1 wherein the first pipe is welded to the vertical portion of the plate.

3. Apparatus as in claim 2 wherein the first and second pipes have vertically displaced holes so that they can be bolted together with adjustable vertical movement of the second pipe.

4. Apparatus as in claim 3 wherein the second pipe is rotatable with respect to the first pipe.

* * * * *